US010161164B2

(12) United States Patent
Kang et al.

(10) Patent No.: US 10,161,164 B2
(45) Date of Patent: Dec. 25, 2018

(54) DISHWASHER

(71) Applicant: Samsung Electronics Co., Ltd., Suwon-si, Gyeonggi-do (KR)

(72) Inventors: Wan Ku Kang, Uiwang-si (KR); Jea Won Lee, Hwaseong-si (KR); Kyung Han Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 945 days.

(21) Appl. No.: 14/515,866

(22) Filed: Oct. 16, 2014

(65) Prior Publication Data

US 2015/0108885 A1 Apr. 23, 2015

(30) Foreign Application Priority Data

Oct. 18, 2013 (KR) ..... 10-2013-0124494

(51) Int. Cl.

| | |
|---|---|
| ***A47L 15/42*** | (2006.01) |
| ***E05B 65/00*** | (2006.01) |
| ***E06B 5/00*** | (2006.01) |
| ***E06B 7/16*** | (2006.01) |
| ***A47L 15/48*** | (2006.01) |

(52) U.S. Cl.

CPC ..... *E05B 65/001* (2013.01); *A47L 15/4259* (2013.01); *A47L 15/488* (2013.01); *E06B 5/00* (2013.01); *E06B 7/16* (2013.01); *A47L 15/4246* (2013.01); *A47L 2401/34* (2013.01); *A47L 2501/22* (2013.01)

(58) Field of Classification Search

None

See application file for complete search history.

(56) References Cited

U.S. PATENT DOCUMENTS

| | | | | |
|---|---|---|---|---|
| 8,905,494 | B2 * | 12/2014 | Kilic | A47L 15/0034 312/222 |
| 9,681,252 | B2 * | 6/2017 | Dence | H04W 4/001 |
| 2010/0043250 | A1 | 2/2010 | Berends et al. | |
| 2013/0057134 | A1 | 3/2013 | Kilic | |

FOREIGN PATENT DOCUMENTS

| | | | |
|---|---|---|---|
| EP | 2210547 | | 7/2010 |
| FR | 2997283 | * | 2/2014 |
| FR | 2997283 | | 5/2014 |

OTHER PUBLICATIONS

European Office Action dated Dec. 12, 2016 from European Patent Application No. 14189244.8, 36 pages.

* cited by examiner

*Primary Examiner* — Michael E Barr
*Assistant Examiner* — Jason P Riggleman
(74) *Attorney, Agent, or Firm* — Staas & Halsey LLP

(57) ABSTRACT

A door opening unit for automatically opening a door for a dishwasher includes an actuator, a link member that makes a straight motion due to pressurization of the actuator and has a plurality of legs, a plurality of rotation levers that are connected to the plurality of legs of the link member, and a plurality of pressurization members that are connected to the plurality of rotation levers. Since the plurality of pressurization members may pressurize a plurality of points of the door, the door may be more smoothly opened. Also, the door opening unit for automatically opening the door includes a restoring spring that restores positions of the plurality of pressurization members when power to the actuator is turned off.

8 Claims, 12 Drawing Sheets

DISHWASHER

CROSS-REFERENCE TO RELATED APPLICATIONS

This application claims the benefit of Korean Patent Application No. 10-2013-0124494, filed on Oct. 18, 2013 in the Korean Intellectual Property Office, the disclosure of which is incorporated herein by reference.

BACKGROUND

1. Field

Embodiments disclosed herein relate to a unit for automatically opening a door of a dishwasher.

2. Description of the Related Art

In general, a dishwasher refers to a home appliance for washing dishes that may include a main body, a washing bath disposed in the main body, a basket disposed in the washing bath so as to accommodate the dishes, a sump in which washing water is collected and stored, a spray unit that sprays the washing water toward the dishes, a washing pump that pumps the washing water of the sump to the spray unit, a discharging pump that discharges the washing water of the sump toward an outer side of the main body, and a heater that heats the washing water.

Generally, the dishwasher may perform a water supply operation of supplying water into the sump, a washing operation of washing the dishes by pumping the water of the sump and spraying the water toward the dishes, a discharging operation of discharging the washing water of the sump and waste toward the outer side of the main body after the washing operation is finished, and a drying operation of drying the dishes in the washing bath after the washing operation is finished.

The washing bath may be provided so that a front side of the washing bath through which the dishes may be put in or taken out is opened. When the washing operation is performed, the opened front side of the washing bath is closed by a door. The door is coupled to the main body so as to be rotatable about a rotation shaft.

If the washing operation is finished, humid air in the washing bath may be discharged toward the outer side of the main body, and the door may be opened so that drying efficiency of the washing bath can be improved. An example of the dishwasher is disclosed in U.S. Patent Application Publication Nos. US 2010/0043250 A1 and US 2013/0057134 A1. The dishwasher disclosed in these publications includes a shaft disposed adjacent to a door, an actuator, and a transfer mechanism that transfers power generated in the actuator to the shaft. When the actuator operates, power of the actuator is transferred to the shaft via the transfer mechanism, and the shaft pushes the door open.

SUMMARY

Therefore, it is an aspect of the disclosure to provide a dishwasher including a unit for automatically opening a door in which, when the door is opened, a plurality of points of the door are pressurized so that the door can be more smoothly opened.

It is another aspect of the disclosure to provide a dishwasher including a unit for automatically opening a door in which, when opening of the door is finished, a pressurization member that pressurizes the door is provided to be restored to its original position so that esthetic appeal of an exterior of the dishwasher and durability of the dishwasher can be improved.

It is still another aspect of the disclosure to provide a dishwasher including a unit for automatically opening a door in which power transfer can be more smoothly performed using a cam curved surface.

Additional aspects of the disclosure will be set forth in part in the description which follows and, in part, will be apparent from the description, or may be learned by practice of the disclosure.

In accordance with one aspect of the disclosure, a dishwasher may include a main body, a washing bath that is provided in the main body and washes dishes, a door that is rotatably coupled to the main body and opens and closes the washing bath, and a door opening unit for automatically opening the door that automatically opens the door so that humid air in the washing bath is capable of being discharged after a washing operation is finished. The door opening unit for automatically opening the door may include: an actuator that applies force to the unit for automatically opening the door in one direction when power is applied to the actuator, a link member that makes a straight motion due to pressurization of the actuator and has a plurality of legs, a plurality of rotation levers that are connected to the plurality of legs of the link member so as to make rotation motions about a rotation shaft while interlocked with the straight motion of the link member, a plurality of pressurization members that are connected to the plurality of rotation levers and that pressurize and open the door so as to make straight motions while interlocked with the rotation motions of the plurality of rotation levers, a buffer spring provided between the actuator and the link member, and a restoring spring that is provided to restore the plurality of pressurization members to original positions of the plurality of pressurization members.

The plurality of pressurization members may pressurize the door at right and left sides of the door.

The door opening unit for automatically opening the door may further include a case in which the actuator, the link member, the plurality of rotation levers, the plurality of pressurization members, the buffer spring, and the restoring spring are accommodated.

One end of the restoring spring may be supported on the link member, and the other end of the restoring spring may be supported on the case.

The dishwasher may further include a latch provided to lock the door when the door is closed.

When the plurality of pressurization members pressurize the door, locking of the latch may be released, and the door may be opened.

The actuator may include a heater that dissipates heat when power is applied to the heater, an expansion member that is heated by the heater and thermally expands, and a rod that moves in one direction due to the expansion member.

Here, the expansion member may include paraffin.

When the power is turned off, the plurality of pressurization members may be restored to original positions thereof due to an elastic force of the restoring spring, and the door may be maintained in an opened state.

In accordance with an aspect of the disclosure, a dishwasher may include a main body, a washing bath that is provided in the main body and washes dishes, a door that is rotatably coupled to the main body and opens and closes the washing bath, and a door opening unit for automatically opening the door that automatically opens the door so that humid air in the washing bath is capable of being discharged after a washing operation is finished. The door opening unit for automatically opening the door may include: an actuator that applies force to the unit for automatically opening the door in one direction when power is applied to the actuator, a link member that makes a straight motion due to pressurization of the actuator, a cam member that is connected to the link member so as to make a rotation motion about a rotation shaft while interlocked with the straight motion of the link member and that has a cam curved surface, a pressurization member having one end thereof that contacts the cam curved surface so as to make a straight motion while interlocked with the rotation motion of the cam member, the pressurization member pressurizing and opening the door, a buffer spring provided between the actuator and the link member, and a restoring spring that is provided to restore the pressurization member to an original position of the pressurization member.

The cam curved surface may be provided so that a distance between the cam curved surface and the rotation shaft is increased as the cam curved surface gets closer to an end point of the cam curved surface from a starting point of the cam curved surface, and when the cam member is rotated, the cam curved surface may pressurize the pressurization member.

The door opening unit for automatically opening the door may further include a case in which the actuator, the link member, the cam member, the pressurization member, the buffer spring, and the restoring spring are accommodated.

One end of the restoring spring may be supported on the pressurization member, and the other end of the restoring spring may be supported on the case.

The pressurization member may include a spring support portion that protrudes in a radial direction so as to support one end of the restoring spring.

The dishwasher may further include a latch provided to lock the door when the door is closed.

When the pressurization member pressurizes the door, locking of the latch may be released, and the door may be opened.

The actuator may include a heater that dissipates heat when power is applied to the heater, an expansion member that is heated by the heater and thermally expands, and a rod that moves in one direction due to the expansion member.

When the power is turned off, the pressurization member may be restored to an original position thereof due to an elastic force of the restoring spring, and the door may be maintained in an opened state.

In accordance with an aspect of the disclosure, a dishwasher may include a main body, a washing bath that is provided in the main body, a door that is rotatably coupled to the main body to access the washing bath, and an automatic door opener to automatically open the door. The automatic door opener may include an actuator that applies a force in a first direction when power is applied to the actuator, a link member that moves in a first direction due to the force applied by the actuator, at least one rotation member that is connected to the link member so as to make a rotation motion about at least one rotation shaft when the link member moves in the first direction, at least one pressurization member having one end to receive a rotational force from the at least one rotation member to move the at least one pressurization member towards the door, and a restoring spring that is provided to restore the at least one pressurization member to an original position.

The dishwasher may include a plurality of pressurization members and a plurality of rotation members connected to the link member. A first rotation member may be connected to a first leg of the link member and a second rotation member may be connected to a second leg of the link member. A first pressurization member may receive a rotational force from the first rotation member and may be disposed on one side of a central portion of the door, and a second pressurization member may receive a rotational force from the second rotation member and may be disposed on the other side of the central portion of the door.

The at least one rotation member may include a cam member that is connected to the link member so as to make a rotation motion about the at least one rotation shaft when the link member moves in the first direction. The cam member may have a cam curved surface, and the one end of the at least one pressurization member may receive the rotational force from the cam member when the cam curved surface contacts the one end of the at least one pressurization member to moves the at least one pressurization member towards the door. The first direction may be perpendicular to a movement direction of the pressurization member.

The automatic door opener may further include a buffer spring provided between the actuator and the link member case. The automatic door opener may further include a case in which the actuator, the link member, the at least one rotation member, the at least one pressurization member, the buffer spring, and the restoring spring are accommodated.

The one end of the restoring spring may be supported on the case and the other end of the restoring spring may be supported on the link member or the at least one pressurization member.

The actuator may include a heater that dissipates heat when power is applied to the heater, an expansion member that is heated by the heater and thermally expands, and a rod that moves in the first direction due to the expansion member. When the power applied to the actuator is turned off, the at least one pressurization member may be restored to an original position due to an elastic force of the restoring spring, and the door may be maintained in an opened state.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
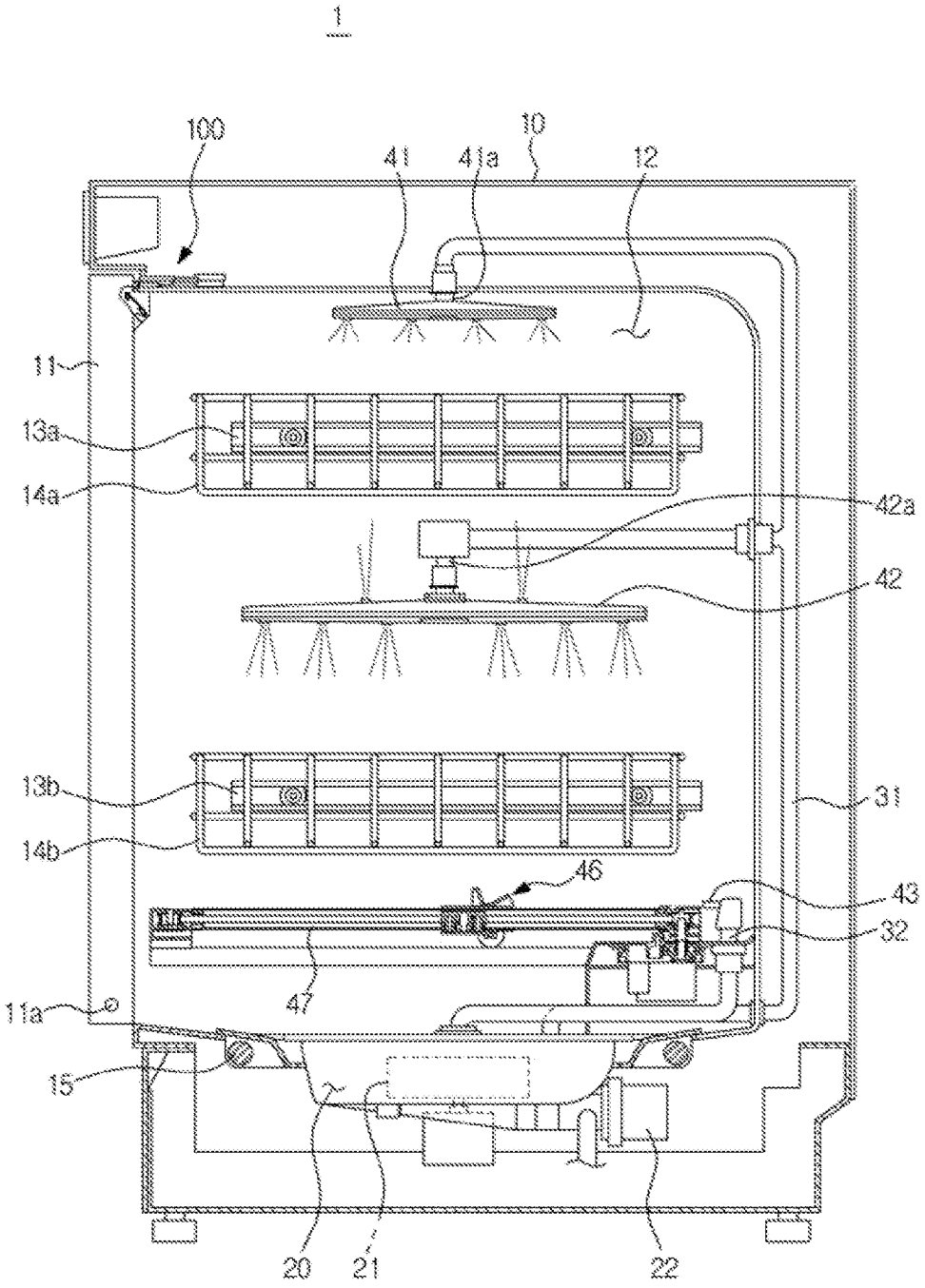
FIG. 1 schematically illustrates a structure of a dishwasher in accordance with an embodiment of the disclosure.

Reference will now be made in detail to embodiments of the disclosure, examples of which are illustrated in the accompanying drawings, wherein like reference numerals refer to like elements throughout.

Figure 2:
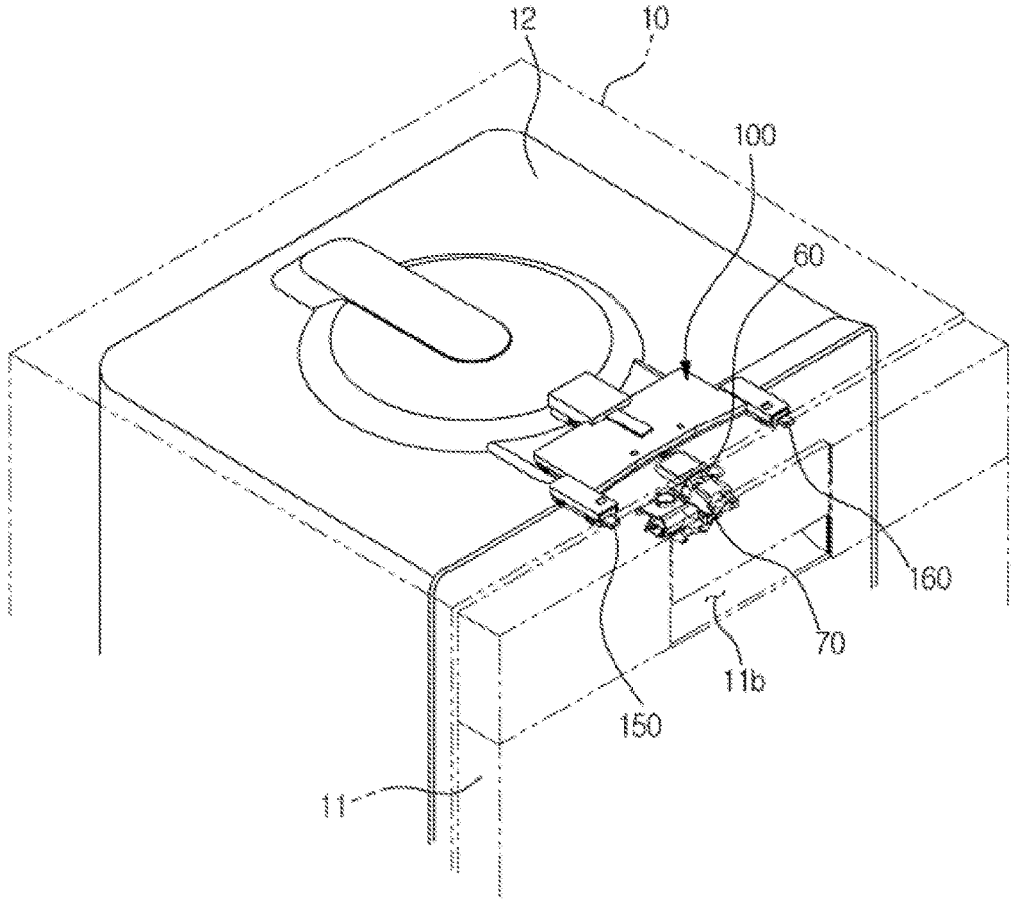
FIG. 2 is a perspective view illustrating a state in which a door of the dishwasher illustrated in FIG. 1 is closed.
Figure 3:
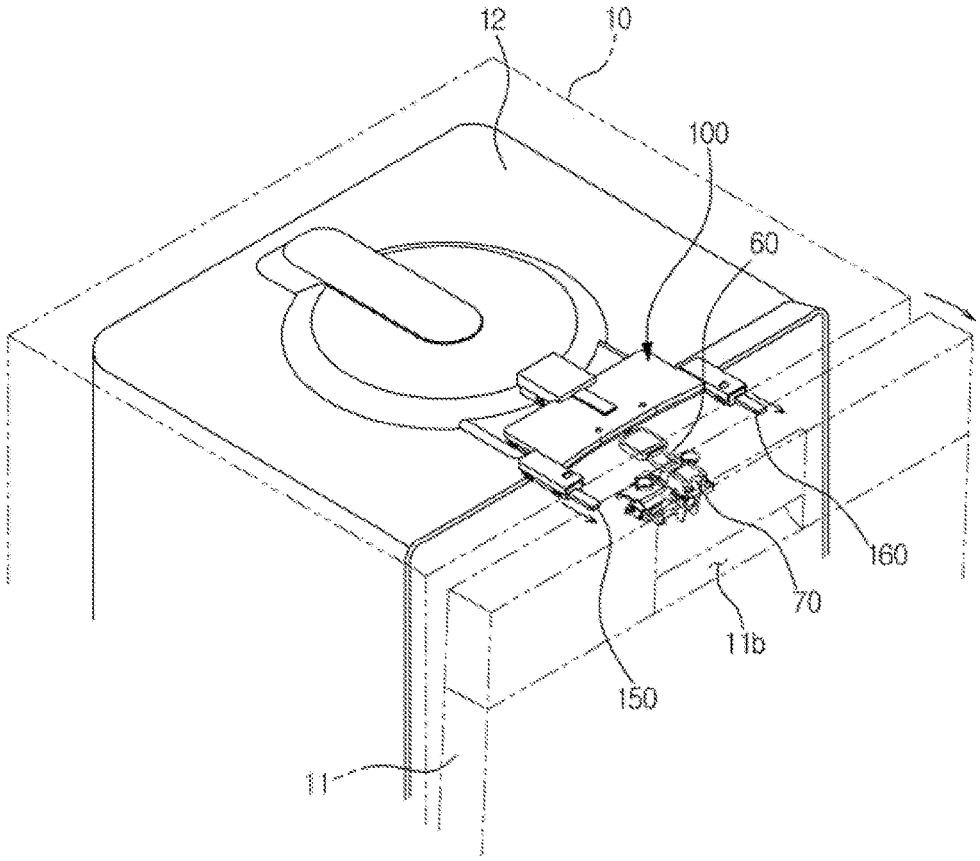
FIG. 3 is a perspective view illustrating a state in which a unit for automatically opening the door of the dishwasher of FIG. 1 opens the door.
Figure 4:
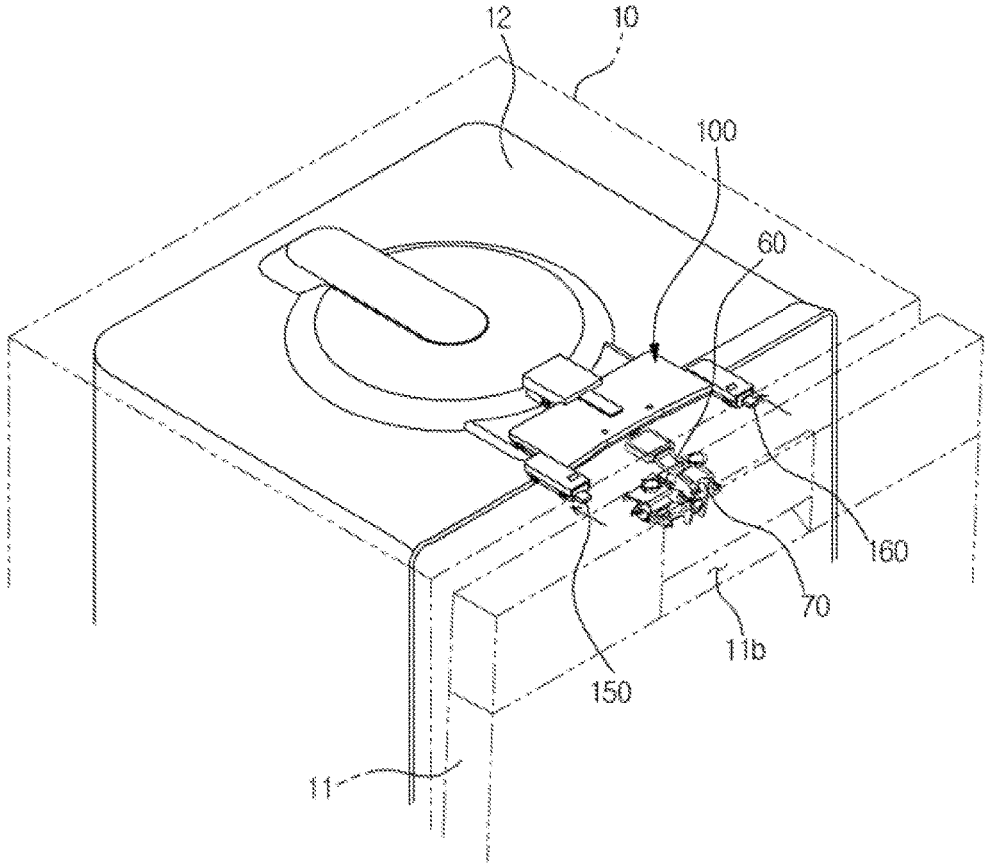
FIG. 4 is a perspective view illustrating a state in which pressurization members are restored to their original positions after the door of the dishwasher of FIG. 1 is opened.

FIG. 1 schematically illustrates a structure of a dishwasher in accordance with an embodiment of the disclosure, FIG. 2 is a perspective view illustrating a state in which a door of the dishwasher illustrated in FIG. 1 is closed, FIG. 3 is a perspective view illustrating a state in which a unit for automatically opening the door of the dishwasher of FIG. 1 opens the door, and FIG. 4 is a perspective view illustrating a state in which pressurization members are restored to their original positions after the door of the dishwasher of FIG. 1 is opened.

Referring to FIGS. 1 through 4, a dishwasher 1 may include a main body 10 that constitutes an exterior, a washing bath 12 disposed in the main body 10, baskets 14*a* and 14*b* that are disposed in the washing bath 12 and accommodate dishes, a sump 20 in which washing water is stored, and spray units 41, 42, and 43 that spray the washing water.

The washing bath 12 may be provided to have approximately a box shape and has an opened front side through which the dishes may be put in or taken out. The opened front side of the washing bath 12 may be opened and closed by a door 11. The door 11 may be coupled to the main body 10 so as to be rotatable about a rotation shaft 11*a*. In a state in which the door 11 is closed, the door 11 may be maintained in a locked state by a latch (see 70 of FIG. 2).

The latch 70 may be provided at the door 11. A locker 60 may be provided at the washing bath 12 or the main body 10 so as to correspond to the latch 70. The latch 70 may be coupled to the locker 60 and may lock the door 11. If a predetermined force is applied to the latch 70 and the locker 60 so as to separate the latch 70 and the locker 60 that are coupled to each other, the latch 70 and the locker 60 may be separated from each other, and the door 11 may be unlocked. The latch 70 and the locker 60 may be provided to have a configuration among various well-known configurations. Generally, a user may open the door by applying a force to a mechanism 11*b* (e.g., a handle, lever, button, etc.) which is installed in the door (e.g., in an opening of the door). The force applied to the mechanism 11*b* may be transmitted to latch 70 and the locker 60 so as to separate the latch 70 and the locker 60 from each other, and the door 11 may be unlocked.

The baskets 14*a* and 14*b* may include an upper basket 14*a* and a lower basket 14*b*. The upper basket 14*a* may be supported on an upper rack 13*a*, and the lower basket 14*b* may be supported on a lower rack 13*b*. The upper rack 13*a* and the lower basket 14*b* may be provided in the washing bath 12 so as to be slidable in forward and backward directions.

A washing pump 21 that pumps stored water to the spray units 41, 42, and 43 may be provided in the sump 20. Washing water pumped by the washing pump 21 may be supplied to the first spray unit 41 and the second spray unit 42 via a first supply pipe 31 and/or may be supplied to the third spray unit 43 via a second supply pipe 32.

For example, the first spray unit 41 may be provided at an upper side of the upper basket 14*a*, the second spray unit 42 may be provided between the upper basket 14*a* and the lower basket 14*b*, and the third spray unit 43 may be provided below the lower basket 14*b*.

The first spray unit 41 may be provided to be rotated about a rotation shaft 41*a*, and the second spray unit 42 may be provided to be rotated about a rotation shaft 42*a*.

The first spray unit 41 may spray the washing water toward the dishes accommodated in the upper basket 14*a*, and the second spray unit 42 may spray the washing water toward the dishes accommodated in the upper basket 14*a* and the lower basket 14*b*.

The third spray unit 43 may be provided to be fixed to one side of the washing bath 12, unlike the first spray unit 41 and the second spray unit 42. The third spray unit 43 may spray the washing water in an approximately horizontal direction, for example, in a back to front direction (i.e., spraying in a direction toward the door 11. For example, a direction of the washing water sprayed by the third spray unit 43 in the approximately horizontal direction may be changed by a reflecting plate 46 that is movably disposed in the washing bath 12, and the washing water may be sprayed toward the dishes accommodated in the lower basket 14*b*. The reflecting plate 46 may make a straight reciprocating motion along a guide rail 47.

In this way, in an example embodiment, a spray structure of the washing water may have two rotation structures and one straight reciprocating structure. However, embodiments of the disclosure are not limited thereto.

A heater 15 for heating the washing water and a drain pump 22 for draining the washing water may be provided at a lower part of the washing bath 12.

A unit 100 for automatically opening a door may be provided at an upper part of the washing bath 12. The unit 100 for automatically opening the door may discharge humid air in the washing bath 12 toward an outer side of (external to) the main body 10 after the washing operation of the dishwasher 1 is finished, and may automatically open the door 11 so that drying performance of the washing bath 12 and the dishes may be improved.

The dishwasher 1 may perform a water supply operation of supplying water into the sump 20, a washing operation of pumping the water of the sump 20 and spraying the water toward the dishes, a drain operation of draining the water and waste stored in the sump 20 toward the outer side of the main body 10 after the washing operation is finished, and a drying operation of drying the washing bath 12 and the dishes in the washing bath 12 after the washing operation is finished.

When the washing operation is performed, the heater 15 may heat the washing water at a predetermined temperature, and the heated high-temperature washing water may be sprayed by the spray units 41, 42, and 43 at a high pressure and used to wash the dishes. When the washing operation is performed, the door 11 may be closed and the washing bath 12 may be sealed.

After the washing operation is finished, the unit 100 for automatically opening the door may open the door 11 automatically so that a user need not open the door 11. The unit 100 for automatically opening the door need not fully open the door 11 and instead may partially open the door 11 enough to discharge humidity in the washing bath 12 toward the outer side of (external to) the main body 10. The unit 100 for automatically opening the door may push the door 11 that is locked when the latch 70 and the locker 60 are coupled to each other with a predetermined force so that coupling of the latch 70 and the locker 60 is released and the door 11 is opened.

The unit 100 for automatically opening the door in accordance with an example embodiment of the disclosure may be provided to pressurize not one point but a plurality of points of the door 11 when pressurizing the door 11 so that the door 11 may be smoothly opened.

As will be described below, to this end, the unit 100 for automatically opening the door may include a plurality of pressurization members 150 and 160 that pressurize the door 11.

Also, as illustrated in FIG. 4, the pressurization members 150 and 160 of the unit 100 for automatically opening the door according to an example embodiment of the disclosure may be restored to their original positions after opening of the door 11 is completed. In this way, the pressurization members 150 and 160 may be restored to their original positions so that esthetic appeal of the dishwasher 1 may be improved. Also, physical damage may be prevented from occurring in the door 11 and the unit 100 for automatically opening the door due to collision between the door 11 and the pressurization members 150 and 160 when the user fully opens the door 11 so as to take the dishes in the washing bath 12 out and then closes the door 11 again.

A detailed configuration or arrangement of the unit 100 for automatically opening the door according to an example embodiment of the disclosure will now be described.

Figure 5:
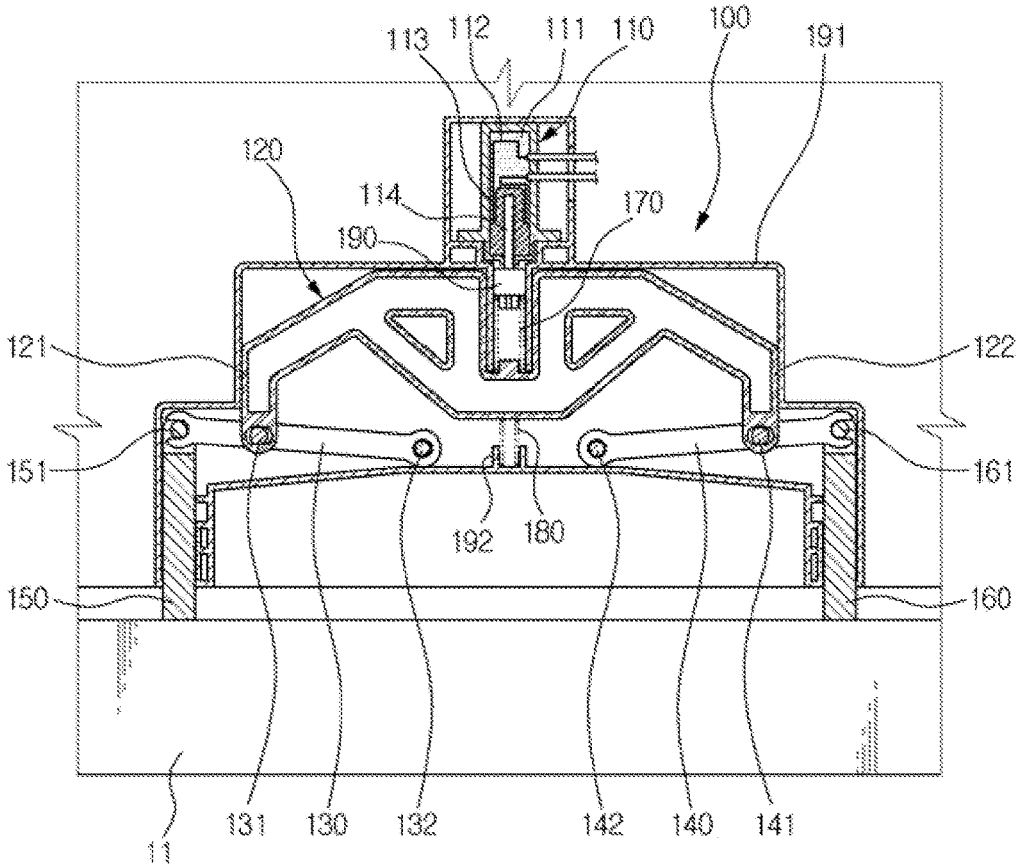
FIG. 5 is a cross-sectional view illustrating a configuration of the unit for automatically opening the door of the dishwasher of FIG. 1.
Figure 6:
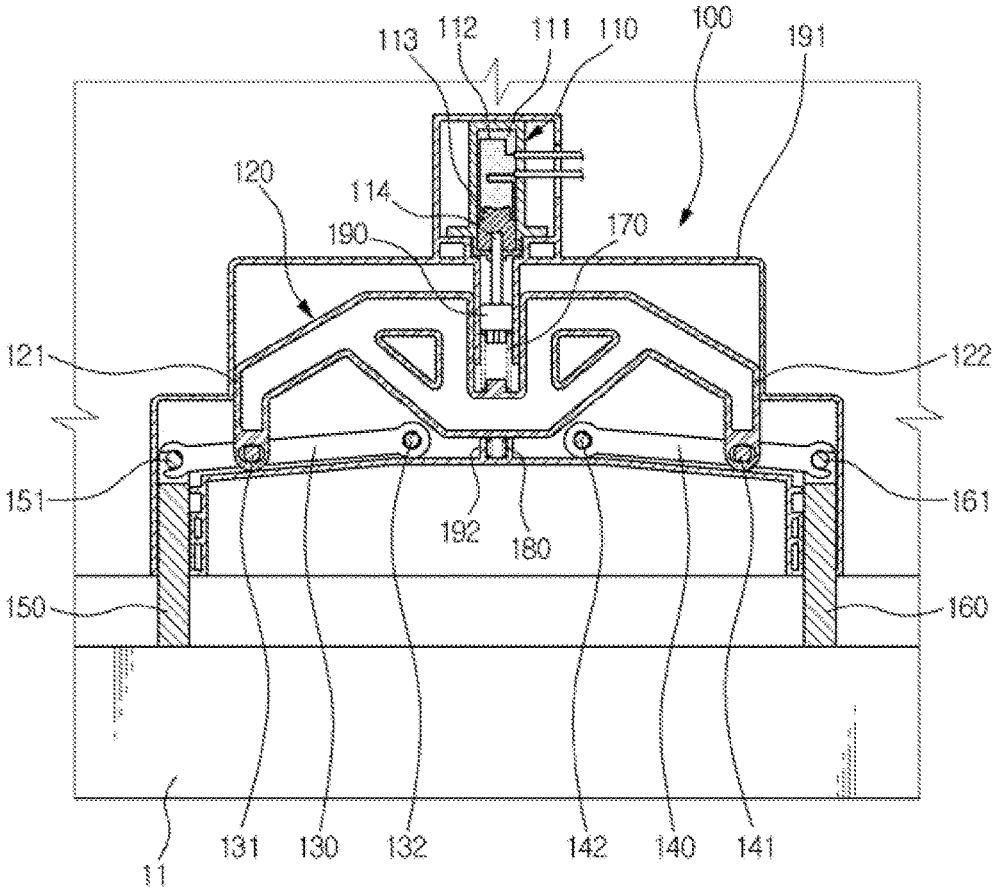
FIG. 6 illustrates an operation of the unit for automatically opening the door of the dishwasher of FIG. 1.

FIG. 5 is a cross-sectional view illustrating a configuration or arrangement of the unit for automatically opening the door of the dishwasher of FIG. 1, and FIG. 6 illustrates an operation of the unit for automatically opening the door of the dishwasher of FIG. 1.

Referring to FIGS. 5 and 6, the unit 100 for automatically opening the door may include an actuator 110 that generates power, a plurality of pressurization members 150 and 160 that pressurize the door 11 using the power of the actuator 110, a link member 120 and a plurality of rotation levers 130 and 140 that transfer the power of the actuator 110 to the plurality of pressurization members 150 and 160, and a case 191 in which the actuator 110, the plurality of pressurization members 150 and 160, the link member 120, and the plurality of rotation levers 130 and 140 are accommodated. For example, the case 191 may be fixed to the main body 10 or the washing bath 12.

The actuator 110 may include an expansion member 111 that thermally expands when the expansion member 111 is heated, a heater 112 that dissipates heat when power is applied to the heater 112, a rod 114 that is pressurized by the expansion member 111 and moves in one direction when the expansion member 111 expands, and a compression tube 113 that surrounds the rod 114. Here, the expansion member 111 may include paraffin, for example.

Force may be transferred to the link member 120 from the rod 114 of the actuator 110, and the link member 120 may make a straight motion. The link member 120 may include a plurality of legs 121 and 122 that transfer forces to the plurality of pressurization members 150 and 160.

A buffer spring 170 may be provided between the link member 120 and the actuator 110. The buffer spring 170 may alleviate the forces transferred to the rod 114 of the actuator 110 when the door 11 is rapidly closed in a state in which the rod 114 of the actuator 110 protrudes in one direction.

A spring support member 190 may be provided at an end of the rod 114 of the actuator 110 and may support the buffer spring 170. Thus, one end of the buffer spring 170 may be supported on the spring support member 190, and the other end of the buffer spring 170 may be supported on the link member 120.

The plurality of rotation levers 130 and 140 may be connected to the plurality of legs 121 and 122 of the link member 120 via connection pins 131 and 141. The plurality of rotation levers 130 and 140 may be provided to be rotatable about the rotation shafts 132 and 142. Thus, the plurality of rotation levers 130 and 140 may make rotation motions about the rotation shafts 132 and 142 while interlocked with the straight motion of the link member 120.

The plurality of pressurization members 150 and 160 may be connected to the plurality of rotation levers 130 and 140 via connection pins 151 and 161. For example, the rotation shafts 132 and 142 may be disposed at one end of the plurality of rotation levers 130 and 140 and the plurality of pressurization members 150 and 160 may be disposed at the other (opposite) ends of the plurality of rotation levers 130 and 140. The plurality of pressurization members 150 and 160 may be provided in such a way that motion in other directions is restricted and motion may be made only in one straight direction due to the case 191. That is, as can be seen in FIGS. 5 and 6, the plurality of pressurization members 150 and 160 may be disposed in a channel or groove (e.g., guide member) which guides the pressurization members 150 and 160 in a direction (e.g. a perpendicular direction with respect to the door) toward and away from the door 11. Thus, the plurality of pressurization members 150 and 160 may make straight motions while interlocked with rotation motions of the plurality of rotation levers 130 and 140 and may pressurize the door 11.

The plurality of pressurization members 150 and 160 may pressurize the door 11 at right and left sides of the door 11, for example. That is, as shown in FIGS. 5 and 6, the actuator 110, expansion member 111, and rod 114 may be disposed at a central location of the door 11, and the pressurization members 150 and 160 may be disposed to the left and right of the central location of the door 11, respectively. Thus, force may be efficiently transferred to the door 11, and the door 11 may be more smoothly opened, compared to a case in which one pressurization member pressurizes the door 11.

The plurality of pressurization members 150 and 160 may apply enough force to the door 11 to separate the latch (see 70 of FIG. 2) and the locker (see 60 of FIG. 2) that lock the door 11 from each other. Also, the plurality of pressurization members 150 and 160 need not fully open the door 11, and the door 11 may be only partially opened so that humid air in the washing bath 12 may be discharged.

If opening of the door 11 is completed, power to the actuator 110 may be turned off, and the expansion member 111 may be reduced to its original size.

The unit 100 for automatically opening the door according to an example embodiment of the disclosure may further include a restoring spring 180 that restores the plurality of pressurization members 150 and 160 to their original positions when power to the actuator 110 is turned off.

The restoring spring 180 may be provided between the link member 120 and the case 191. That is, one end of the restoring spring 180 may be supported on the link member 120, and the other end of the restoring spring 180 may be supported on the case 191. To this end, the case 191 may have a spring support portion 192 that protrudes in a radial direction so as to support one end of the restoring spring 180.

When power to the actuator 110 is turned off, the restoring spring 180 may push the link member 120 with an elastic force. When the link member 120 makes a straight motion, the plurality of rotation levers 130 and 140 may make rotation motions while interlocked with the straight motion of the link member 120, and when the rotation levers 130 and 140 make rotation motions, the plurality of pressurization members 150 and 160 may make straight motions and may be restored to their original positions while interlocked with the rotation motions of the rotation levers 130 and 140. In this case, the door 11 may be maintained in the opened state.

With reference to FIGS. 5 and 6, before power is applied to the actuator 110, a portion of the link member 120 may be disposed adjacent to the case 191, and the pressurization members 150 and 160 may be substantially accommodated within the case 191. When power is applied to the actuator 110 and heater 112, the expansion member 111 may thermally expand when the expansion member 111 is heated by the heater 112. The expansion of the expansion member 111 may cause the rod 114 to move in a direction (e.g., a perpendicular direction with respect to the door) toward the door 11, thereby providing a force to the link member 120 which also moves in a direction (e.g., a perpendicular direction with respect to the door) toward the door 11. Movement of the link member 120 toward the door 11 causes rotational movement of rotation levers 130 and 140 about the rotation shafts 132 and 142 (e.g., in a counterclockwise direction for rotation lever 130 and a clockwise direction for rotation lever 140). Pressurization members 150 and 160 may thus move in a direction (e.g., a perpendicular direction with respect to the door) toward the door 11 by virtue of the rotation motions of the rotation levers 130 and 140.

As described above, the plurality of pressurization members 150 and 160 may be restored to their original positions such that, after all operations of the dishwasher 1 are completed, the plurality of pressurization members 150 and 160 do not protrude toward the door 11 and thus esthetic appeal of the dishwasher 1 may be improved, and when the user fully opens the door 11 so as to take out the dishes in the washing bath 12 and then takes out the dishes and closes the door 11 again, collision between the door 11 and the plurality of pressurization members 150 and 160 does not occur, preventing damage to the door 11 and the unit 100 for automatically opening the door.

Figure 7:
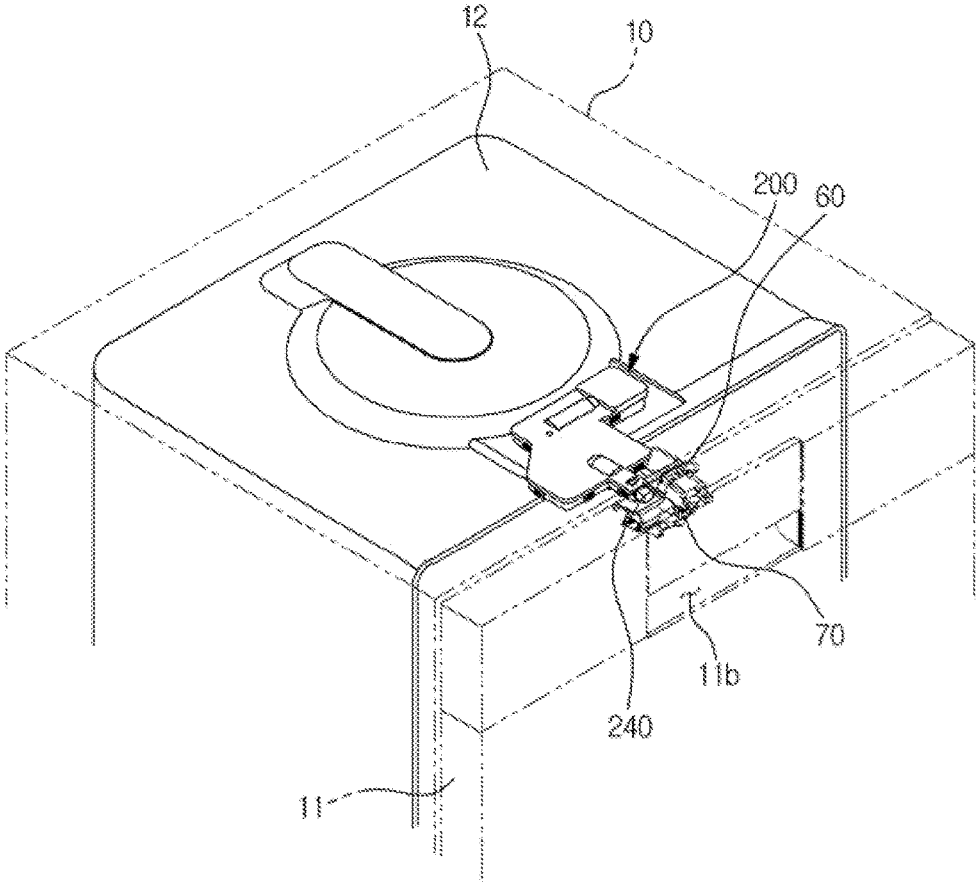
FIG. 7 is a perspective view illustrating a state in which a door of a dishwasher in accordance with an embodiment of the disclosure is closed.
Figure 8:
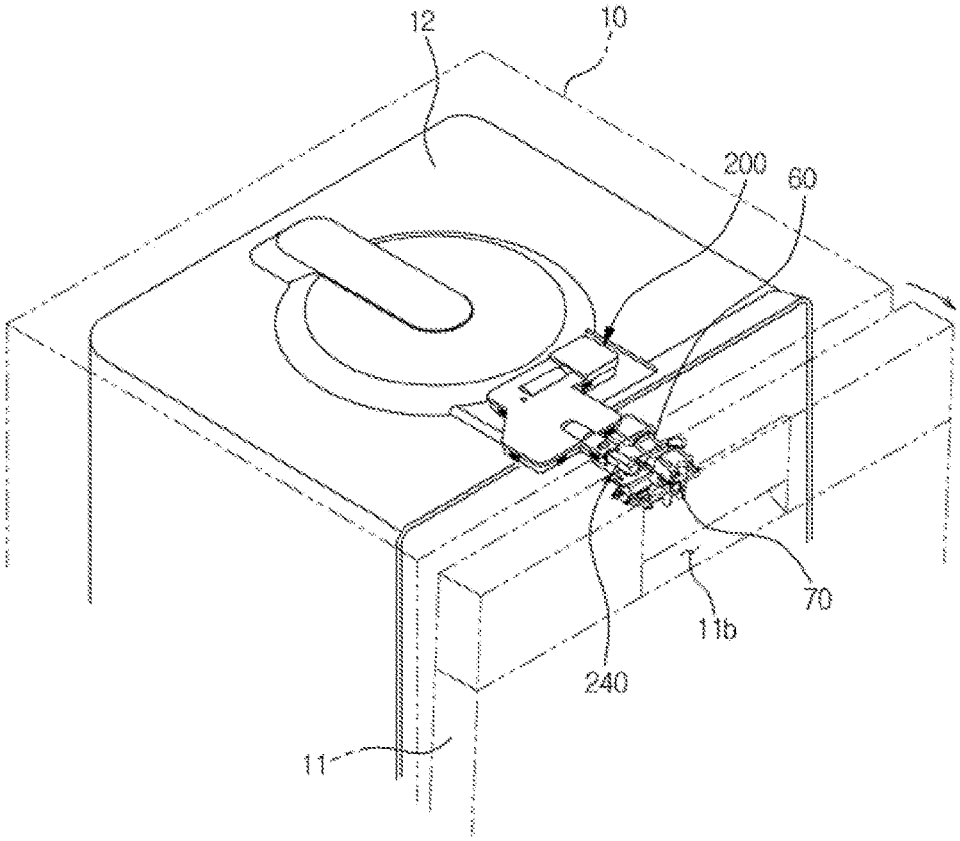
FIG. 8 is a perspective view illustrating a state in which the unit for automatically opening the door of the dishwasher of FIG. 7 opens the door.
Figure 9:
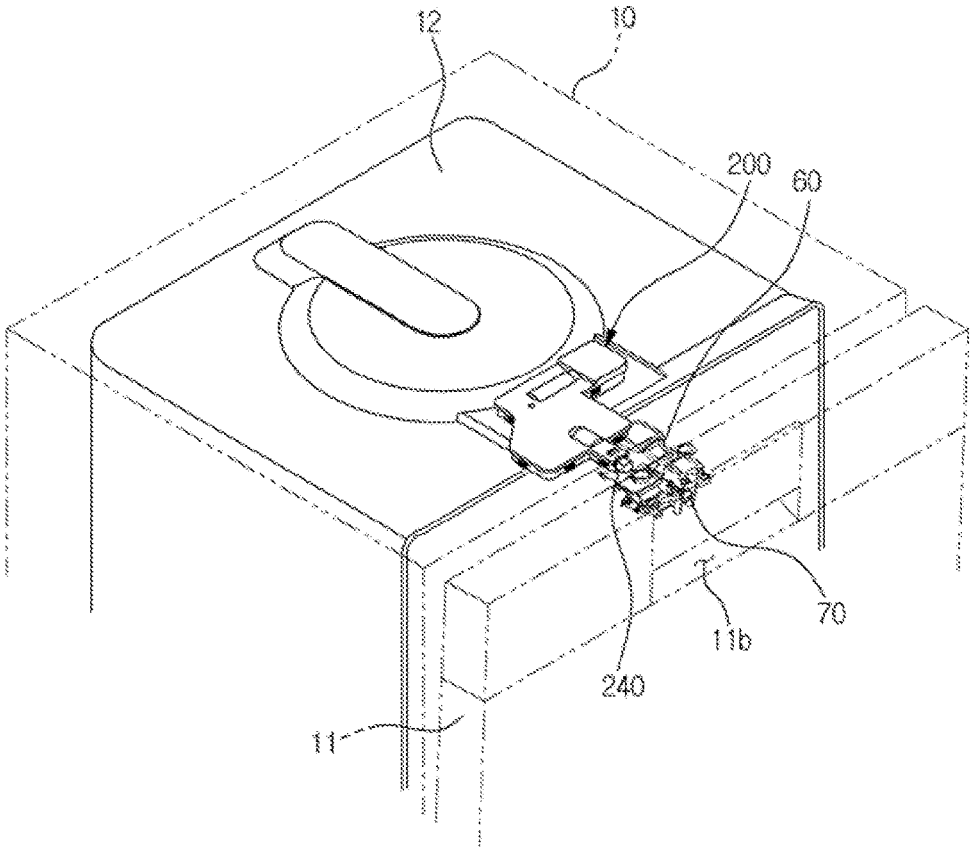
FIG. 9 is a perspective view illustrating a state in which a pressurization member is restored to its original position after the door of the dishwasher of FIG. 7 is opened.
Figure 10:
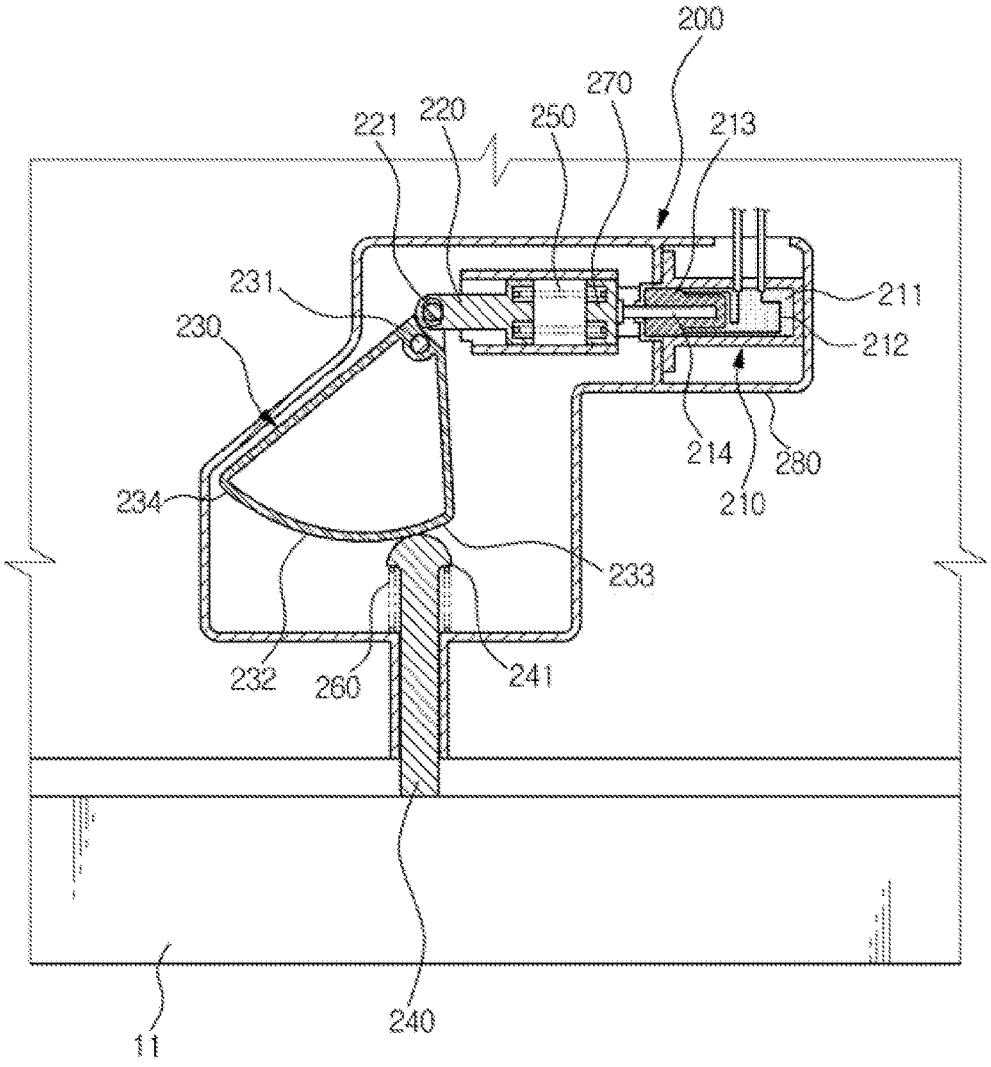
FIG. 10 is a cross-sectional view illustrating a configuration of the unit for automatically opening the door of the dishwasher of FIG. 7.
Figure 11:
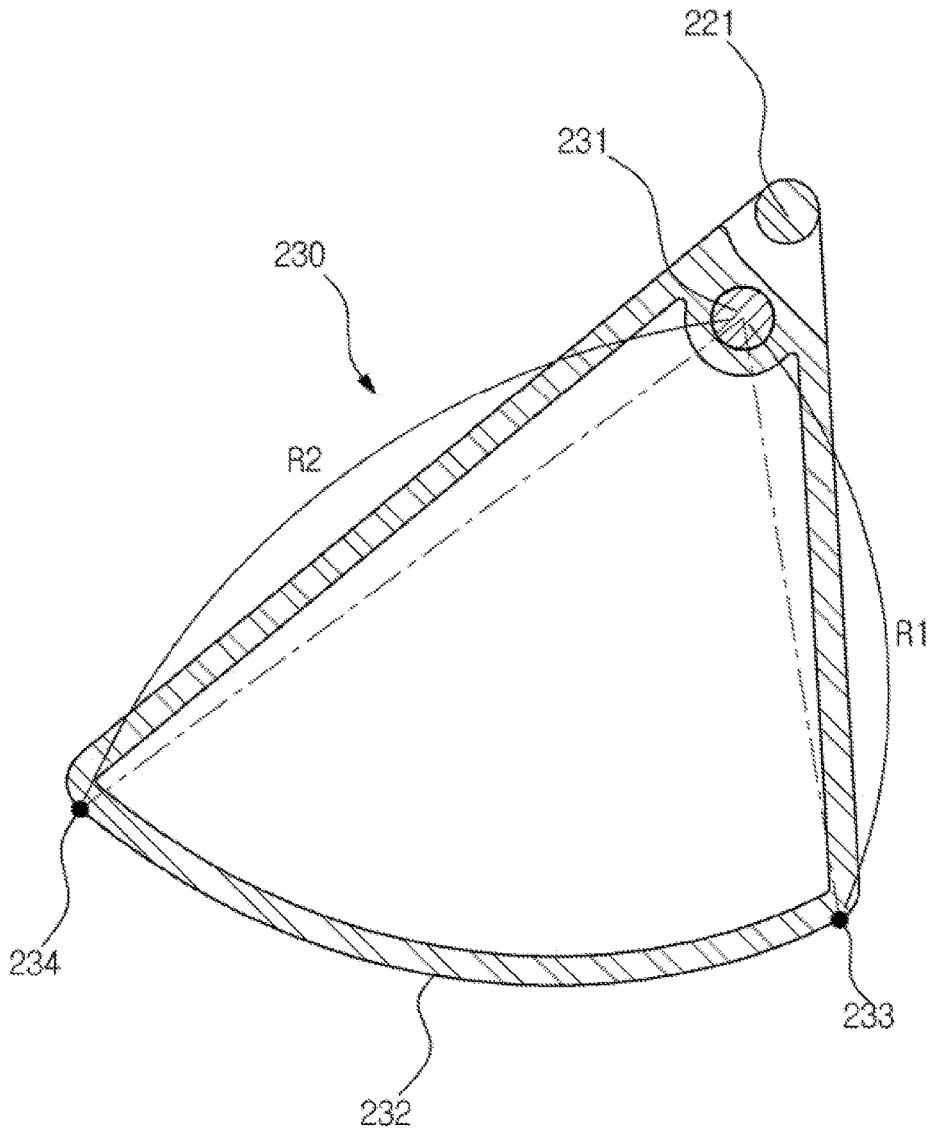
FIG. 11 is an enlarged view of a cam member of the dishwasher of FIG. 7.
Figure 12:
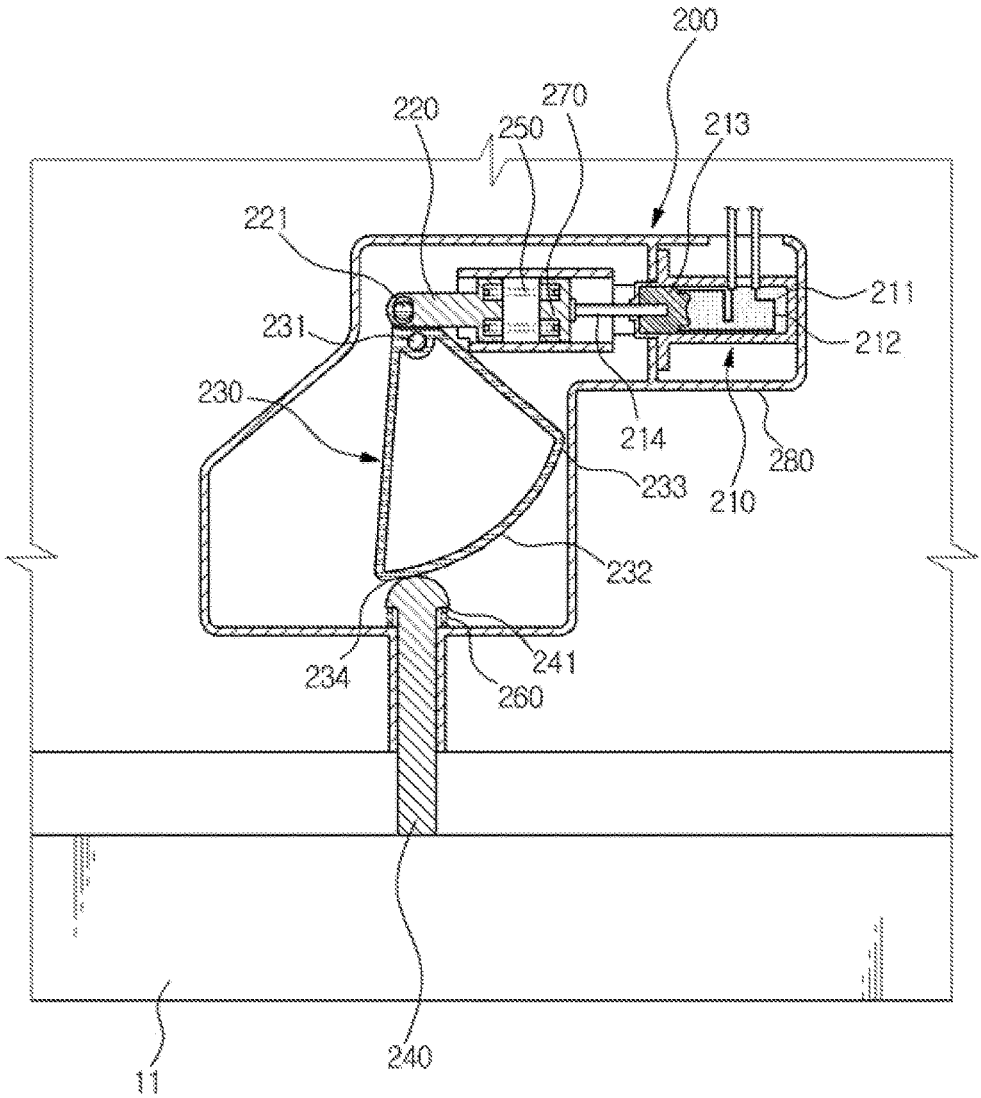
FIG. 12 illustrates an operation of the unit for automatically opening the door of the dishwasher of FIG. 7.

FIG. 7 is a perspective view illustrating a state in which a door of a dishwasher in accordance with an embodiment of the disclosure is closed, FIG. 8 is a perspective view illustrating a state in which the unit for automatically opening the door of the dishwasher of FIG. 7 opens the door, and FIG. 9 is a perspective view illustrating a state in which a pressurization member is restored to its original position after the door of the dishwasher of FIG. 7 is opened. FIG. 10 is a cross-sectional view illustrating a configuration or arrangement of the unit for automatically opening the door of the dishwasher of FIG. 7, FIG. 11 is an enlarged view of a cam member of the dishwasher of FIG. 7, and FIG. 12 illustrates an operation of the unit for automatically opening the door of the dishwasher of FIG. 7.

A dishwasher including a unit for automatically opening a door in accordance with an embodiment of the disclosure will be described with reference to FIGS. 7 through 12. Like reference numerals used with respect to FIGS. 1 through 6 and used with respect to FIGS. 7 through 12 refer to the same elements having similar features, and therefore a description thereof will be omitted for the sake of brevity.

A unit 200 for automatically opening the door in accordance with an example embodiment of the disclosure may include an actuator 210 that applies a force to the unit 200 for automatically opening the door in one direction when power is applied to the actuator 210, a link member 220 that makes a straight motion due to pressurization of the actuator 210, a cam member 230 that is connected to the link member 222 via a connection pin 221 so as to make a rotation motion about a rotation shaft 231 while interlocked with the straight motion of the link member 220, a pressurization member 240 that makes a straight motion while interlocked with the rotation motion of the cam member 230 and pressurizes and opens the door 11, and a case 280 in which the actuator 210, the link member 220, the cam member 230 and the pressurization member 240 may be accommodated. For example, the case 280 may be fixed to the main body 10 or the washing bath 12. The pressurization member 240 may be provided in such a way that motion in other directions is restricted and motion may be made only in one straight direction due to the case 280. That is, as can be seen in FIGS. 10 and 12, the pressurization member 20 may be disposed in a channel or groove (e.g., guide member) which guides the pressurization member 240 in a direction (e.g. a perpendicular direction with respect to the door) toward and away from the door 11.

The actuator 210 may include an expansion member 211 that thermally expands when the expansion member 211 is heated, a heater 212 that dissipates heat when power is applied to the heater 212, a rod 214 that is pressurized by the expansion member 211 and moves in one direction when the expansion member 211 expands, and a compression tube 213 that surrounds the rod 214. Here, the expansion member 211 may include paraffin, for example.

A buffer spring 250 may be provided between the link member 220 and the actuator 210. The buffer spring 250 may alleviate force applied to the rod 214 of the actuator 210 when the door 11 is rapidly closed in a state in which the rod 214 of the actuator 210 protrudes in one direction.

A spring support member 270 may be provided at one end of the rod 214 of the actuator 210 and may support the buffer spring 250. Thus, one end of the buffer spring 250 may be supported on the spring support member 270, and the other end of the buffer spring 250 may be supported on the link member 220.

The cam member 230 may have a cam curved surface 232 that contacts the pressurization member 240 so as to pressurize the pressurization member 240 when the cam member 230 makes a rotation motion. The cam curved surface 232 may be provided so that a distance between the cam curved surface 232 and a cam member rotation shaft 231 is increased as the cam curved surface 232 gets closer to an end point (see 234 of FIG. 11) of the cam curved surface 232 from a starting point (see 233 of FIG. 11) of the cam curved surface 232. Through this configuration or arrangement, if the cam member 230 is rotated, the cam curved surface 232 may pressurize the pressurization member 240, and the pressurization member 240 may make a straight motion.

As described above, the unit 200 for automatically opening the door may transfer power generated in the actuator 210 to the pressurization member 240 using the cam member 230 having the cam curved surface 232 so that power transfer efficiency of the dishwasher may be improved.

The unit 200 for automatically opening the door may further include a restoring spring 260 for restoring the pressurization member 240 to its original position when power to the actuator 210 is turned off.

One end of the restoring spring 260 may be supported on the pressurization member 240, and the other end of the restoring spring 260 may be supported on the case 280. To this end, the pressurization member 240 may have a spring support portion 241 that protrudes in a radial direction so as to support one end of the restoring spring 260.

With reference to FIGS. 10 and 11, before power is applied to the actuator 210, the pressurization member 240 may be substantially accommodated within the case 191. When power is applied to the actuator 210 and heater 212, the expansion member 211 may thermally expand when the expansion member 211 is heated by the heater 212. The expansion of the expansion member 211 may cause the rod 214 to move in a first direction which is substantially parallel to the door 11, thereby providing a force to the link member 220 which also moves in the first direction which is substantially parallel to the door 11. Movement of the link member 220 in the first direction causes rotational movement of the cam member 230 about the rotation shaft 231 (e.g., in a counterclockwise direction as shown in FIGS. 10 and 12, although an opposite rotational direction may be implemented in an alternative embodiment). Pressurization member 240 may thus move in a second direction (e.g., a direction which is perpendicular to the door and the first direction) toward the door 11 by virtue of the rotation motion of the cam member 230.

When power to the actuator 210 is turned off due to an action of the restoring spring 260, the pressurization member 240 may be restored to its original position so that esthetic appeal of the dishwasher may be improved and damage caused by collision between the door 11 and the pressurization member 240 when the door 11 is closed may be prevented.

As described above, in a dishwasher according to the example embodiments of the disclosure, a plurality of pressurization members may pressurize a plurality of points of a door so that the door may be more smoothly and reliably opened.

In addition, the plurality of pressurization members that pressurize the door after the door is opened may be restored to their original positions so that, when all operations of the dishwasher are finished, the pressurization members do not protrude so that esthetic appeal of an exterior of the dishwasher may be improved and collision between the pressurization members and the door when the door is closed may be prevented.

Furthermore, a power transfer mechanism using a cam curved surface may more efficiently transfer power of an actuator to the pressurization members.

Although example embodiments of the disclosure have been shown and described, it would be appreciated by those skilled in the art that changes may be made to these embodiments without departing from the principles and spirit of the disclosure, the scope of which is defined in the claims and their equivalents.

What is claimed is:

1. A dishwasher comprising:

a main body;

a washing bath that is provided in the main body;

a door that is rotatably coupled to the main body to access the washing bath; and a door opening unit to automatically open the door, wherein the door opening unit comprises:

an actuator that applies force to the door opening unit in one direction when power is applied to the actuator;

a link member that makes a straight motion due to pressurization of the actuator and has a plurality of legs;

a plurality of rotation levers that are connected to the plurality of legs of the link member so as to make rotation motions about a rotation shaft while interlocked with the straight motion of the link member;

a plurality of pressurization members that are connected to the plurality of rotation levers and that pressurize and open the door so as to make straight motions while interlocked with the rotation motions of the plurality of rotation levers;

a buffer spring provided between the actuator and the link member; and a restoring spring that is provided to restore the plurality of pressurization members to original positions of the plurality of pressurization members.

2. The dishwasher of claim 1, wherein the plurality of pressurization members pressurize the door at right and left sides of the door.

3. The dishwasher of claim 1, wherein the door opening unit further comprises a case in which the actuator, the link member, the plurality of rotation levers, the plurality of pressurization members, the buffer spring, and the restoring spring are accommodated.

4. The dishwasher of claim 3, wherein one end of the restoring spring is supported on the link member, and the other end of the restoring spring is supported on the case.

5. The dishwasher of claim 1, further comprising a latch provided to lock the door when the door is closed.

6. The dishwasher of claim 5, wherein, when the plurality of pressurization members pressurize the door, locking of the latch is released, and the door is opened.

7. The dishwasher of claim 1, wherein the actuator comprises a heater that dissipates heat when power is applied to the heater, an expansion member that is heated by the heater and thermally expands, and a rod that moves in one direction due to the expansion member.

8. The dishwasher of claim 7, wherein, when the power applied to the actuator is turned off, the plurality of pressurization members are restored to original positions thereof due to an elastic force of the restoring spring, and the door is maintained in an opened state.

* * * * *